US007213530B2

(12) United States Patent
Dasilva et al.

(10) Patent No.: US 7,213,530 B2
(45) Date of Patent: May 8, 2007

(54) HATCH OR DOOR SYSTEM FOR SECURING AND SEALING OPENINGS IN MARINE VESSELS

(75) Inventors: Robert A. Dasilva, Lowell, MA (US); Jerome P. Fanucci, Lexington, MA (US); Michael McAleenan, Georgetown, ME (US)

(73) Assignee: Kazak Composites, Incorporated, Woburn, MA (US)

( * ) Notice: Subject to any disclaimer, the term of this patent is extended or adjusted under 35 U.S.C. 154(b) by 0 days.

(21) Appl. No.: 11/248,000

(22) Filed: Oct. 11, 2005

(65) Prior Publication Data

US 2006/0075950 A1 Apr. 13, 2006

Related U.S. Application Data

(63) Continuation-in-part of application No. 10/357,735, filed on Feb. 4, 2003, now Pat. No. 6,953,001.

(60) Provisional application No. 60/354,315, filed on Feb. 4, 2002.

(51) Int. Cl.
*B63B 19/00* (2006.01)

(52) U.S. Cl. ..... 114/117; 49/395; 114/203

(58) Field of Classification Search ..... 114/116, 114/117, 201 R, 203; 49/394, 395
See application file for complete search history.

(56) References Cited

U.S. PATENT DOCUMENTS

| | | | | | |
|---|---|---|---|---|---|
| 904,275 | A | | 11/1908 | Peckham | |
| 1,364,800 | A | | 1/1921 | Peterson | |
| 2,264,426 | A | * | 12/1941 | Young | 114/117 |
| 2,355,025 | A | | 8/1944 | Arthur | 292/45 |
| 2,493,882 | A | | 1/1950 | Lambert | 292/12 |
| 2,493,980 | A | | 1/1950 | Lambert | 292/48 |
| 2,511,267 | A | | 6/1950 | Jacob | 114/117 |
| 3,771,485 | A | | 11/1973 | Brunsell | 114/125 |
| 4,745,708 | A | * | 5/1988 | Roche | 49/395 |
| 5,086,587 | A | | 2/1992 | Andrews | 49/395 |
| 5,199,369 | A | * | 4/1993 | Meyer et al. | 114/117 |
| 6,209,471 | B1 | | 4/2001 | Oomen | 114/117 |
| 6,341,450 | B1 | | 1/2002 | Macander et al. | 52/20 |
| 6,446,393 | B1 | * | 9/2002 | Marston et al. | 49/395 |
| 6,799,396 | B1 | * | 10/2004 | Redfern et al. | 49/395 |

* cited by examiner

*Primary Examiner*—Lars A. Olson
(74) *Attorney, Agent, or Firm*—Weingarten, Schurgin, Gagnebin & Lebovici LLP

(57) ABSTRACT

A hatch or door system for closing an opening in a surrounding structure has a panel assembly having a metal frame enclosing a composite material panel. An operating mechanism is operative in a first stage to hold the panel assembly in the closed position. In a second stage, a discrete-to-continuous latching mechanism of the operating mechanism seals the frame within the opening.

11 Claims, 16 Drawing Sheets

HATCH OR DOOR SYSTEM FOR SECURING AND SEALING OPENINGS IN MARINE VESSELS

CROSS REFERENCE TO RELATED APPLICATIONS

This application is a continuation-in-part of U.S. patent application Ser. No. 10/357,735, filed Feb. 4, 2003, issued as U.S. Pat. No. 6,953,001, on Oct. 11, 2005, the disclosure of which is incorporated herein by reference.

This application claims the benefit under 35 U.S.C. § 119(e) of U.S. Provisional Application No. 60/354,315 filed on Feb. 4, 2002, the disclosure of which is incorporated herein by reference.

STATEMENT REGARDING FEDERALLY SPONSORED RESEARCH OR DEVELOPMENT

N/A

BACKGROUND OF THE INVENTION

Ships and other marine vessels include hatches formed in horizontal surfaces and doors formed in vertical surfaces to allow crewmembers and goods to pass through. A hatch or door must be watertight around all of its edges and sufficiently stiff and strong to withstand the forces applied during use. Hatches are typically formed of metal and are heavy to open and close. Thus, a scuttle sized to allow passage of a single person is typically provided within the hatch. The scuttle must also be watertight. The operating mechanisms to open and close both the hatch and the scuttle are conventionally provided on the hatch itself, adding to the weight.

Hatches and scuttles on ships are traditionally made from steel. During many years of marine service, steel hardware has proven to be relatively inexpensive, to have good resistance to damage from routine operational impacts, to provide inherent EMI and EMP shielding, and to perform well in standard fire tests.

Steel hatches and scuttles have several drawbacks, however. Life cycle costs can be high, due to considerable routine maintenance, such as regular painting to prevent corrosion. Also, the heavy weight makes opening and closing of the hatch and/or scuttle unsafe, particularly in rough weather or in other difficult or dangerous circumstances.

SUMMARY OF THE INVENTION

A hatch system of the present invention provides a hatch panel formed of a composite material. The composite material contributes to a significant reduction in weight over that of a conventional all-metal hatch and scuttle system. The composite hatch panel is bonded to a metal frame, which allows the composite panel to be readily integrated to a metal coaming structure fixed to the ship surrounding the hatch panel. The operating mechanism to open and close the hatch panel is shifted off the movable hatch panel to the fixed coaming structure. The operating mechanism provides a discrete-to-continuous dogging mechanism to distribute mechanical point loads over a greater percentage of the panel's periphery.

DESCRIPTION OF THE DRAWINGS

The invention will be more fully understood from the following detailed description taken in conjunction with the accompanying drawings in which.

DETAILED DESCRIPTION OF THE INVENTION

Figure 1:
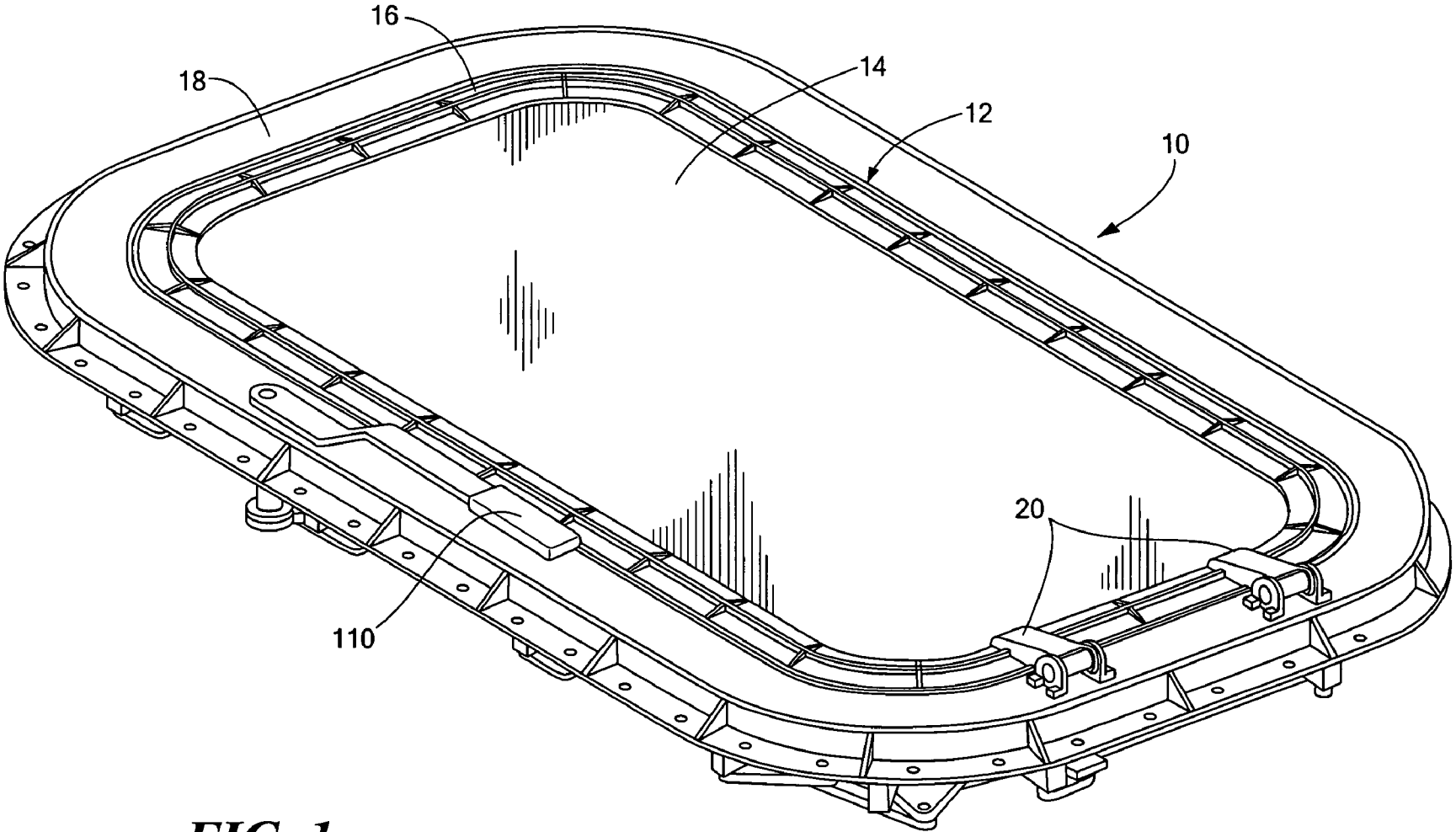
FIG. 1 is an isometric view of a hatch or door system of the present invention.
Figure 2:
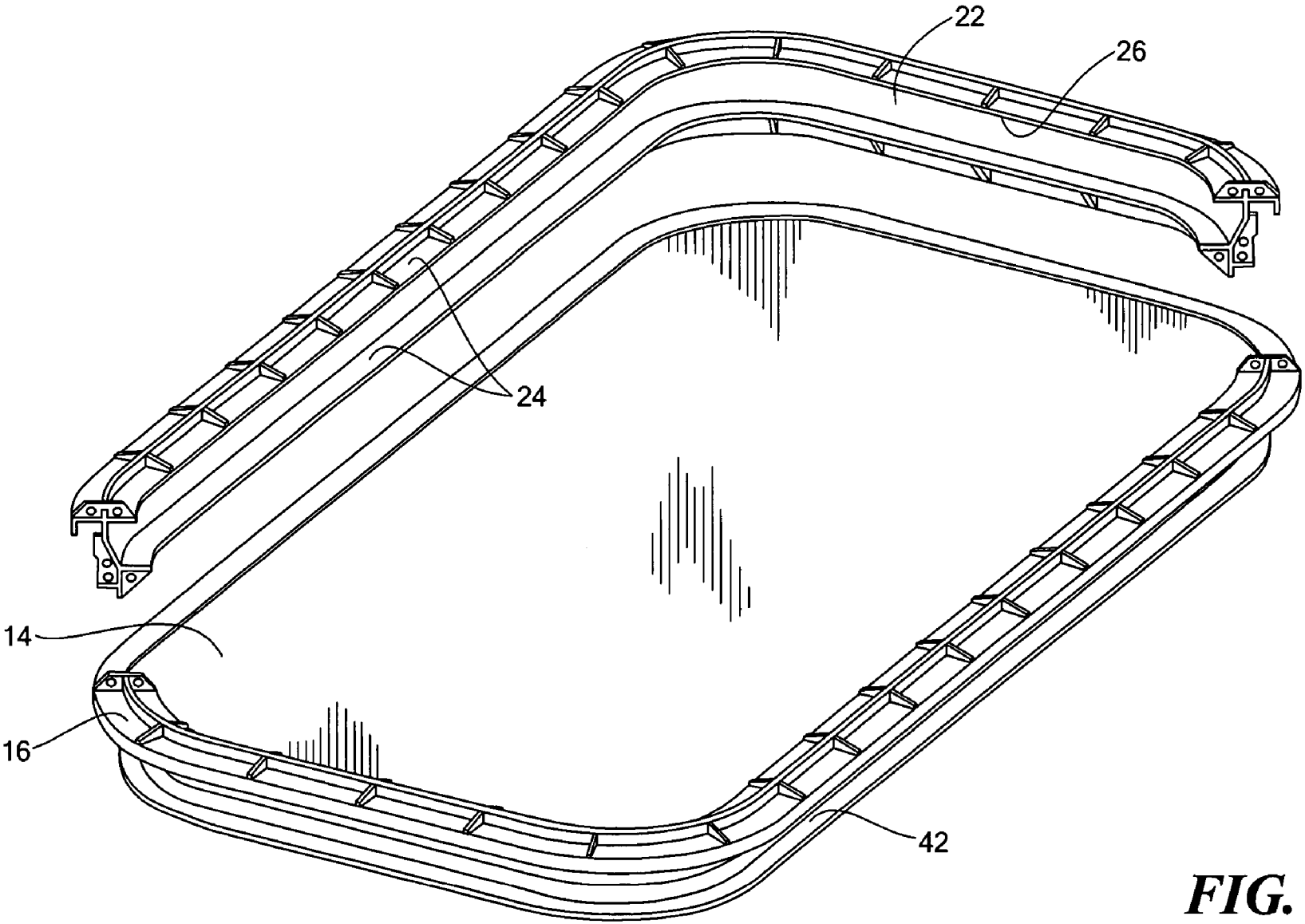
FIG. 2 is an exploded isometric view of a panel assembly of the system of FIG. 1.
Figure 3:
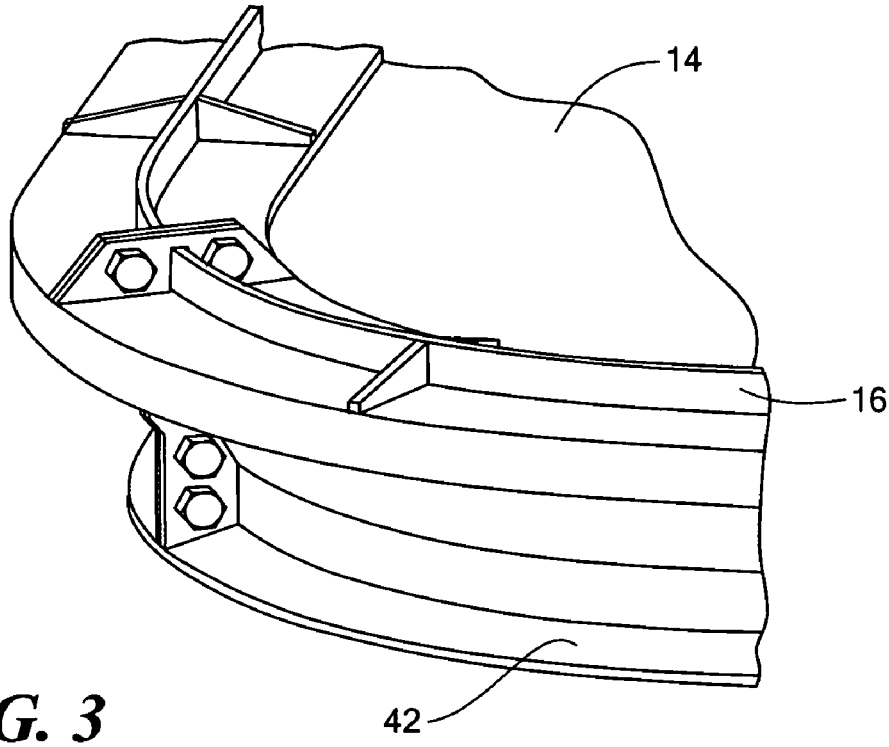
FIG. 3 is a partial isometric view of the panel assembly of FIG. 2.
Figure 4:
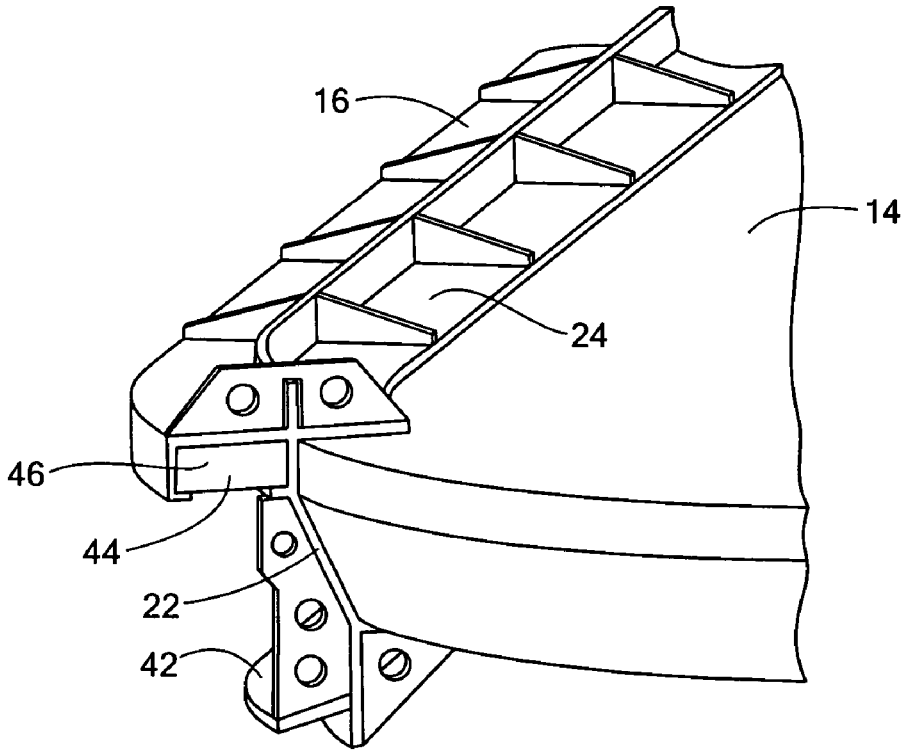
FIG. 4 is a partial, cut away isometric view of the panel assembly of FIG. 2.
Figure 5:
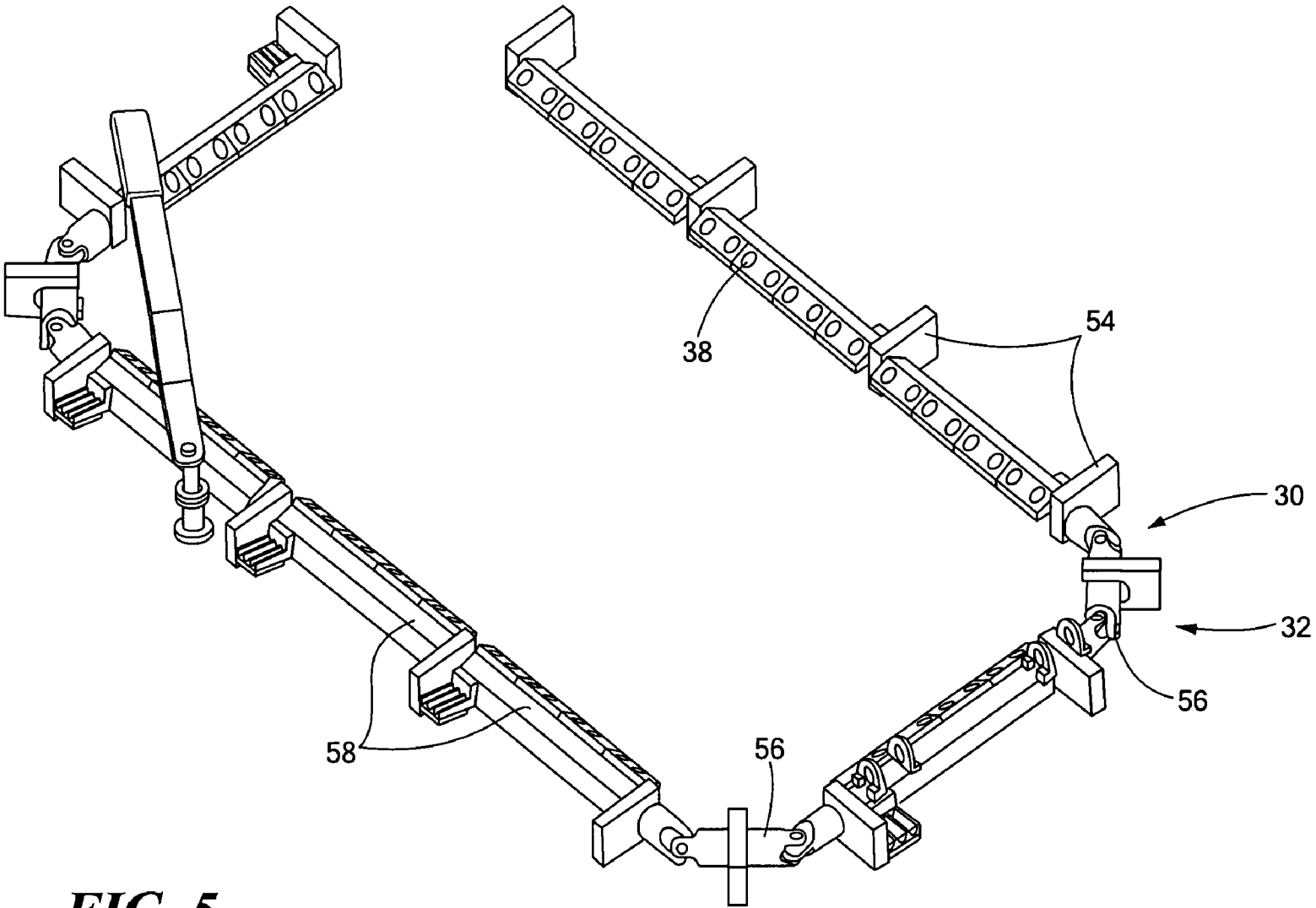
FIG. 5 is a partial view illustrating a shaft mechanism of the operating mechanism of the system of FIG. 1.

Referring to FIGS. 1–7, a hatch or door system 10 of the present invention includes a hatch or door panel assembly 12 including a composite material interior panel 14 fitted within a metal frame 16. The panel assembly is hinged to a surrounding metal coaming structure 18 of a ship with any suitable hinges 20, as illustrated in FIG. 1. An operating mechanism 30 mounted on the surrounding coaming structure closes and seals the hatch panel assembly in two stages. In the first stage, a latching mechanism (described further below) is actuated to hold the panel assembly closed. In a preferred embodiment, closing the panel assembly actuates the latching mechanism. In the second stage, a discrete-to-continuous latching mechanism (described further below) is actuated to pull the panel assembly tight against a seal mechanism, thereby providing a watertight seal.

The composite material of the composite material panel 14 is a fibrous reinforcement impregnated with a matrix material. The panel is bonded to or otherwise suitably mounted within the metal frame 16, which allows the composite panel to be readily integrated to the metal coaming structure 18. The frame includes a circumferential wall 22 that conforms to the sides of the composite panel and upper and lower inwardly facing flanges 24. See FIGS. 2–4. The wall and inward flanges form a recess 26 into which the sides of the composite panel fit. Preferably, the metal frame is formed in two pieces for ease of assembly to the perimeter of the panel. The frame may be bonded or otherwise attached to the panel in any suitable manner, such as with an adhesive. The frame also includes a circumferential outwardly extending latching flange or lip 42 and a circumferentially extending recess 44 in which a gasket material 46 is located. The frame may be made of any suitable metal, such as steel.

Figure 6:
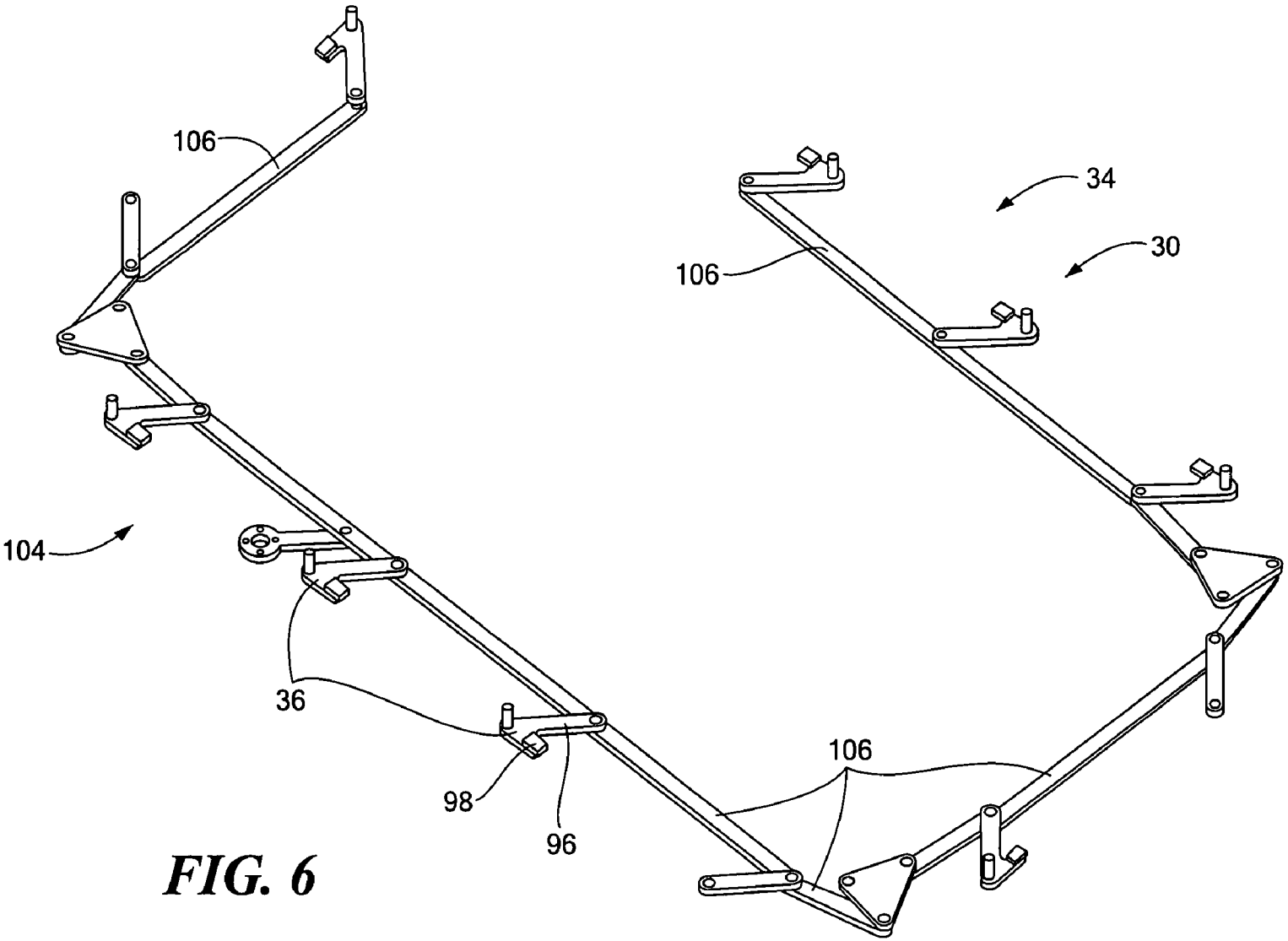
FIG. 6 is a partial view illustrating a linkage mechanism of the operating mechanism of the system of FIG. 1.
Figure 7:
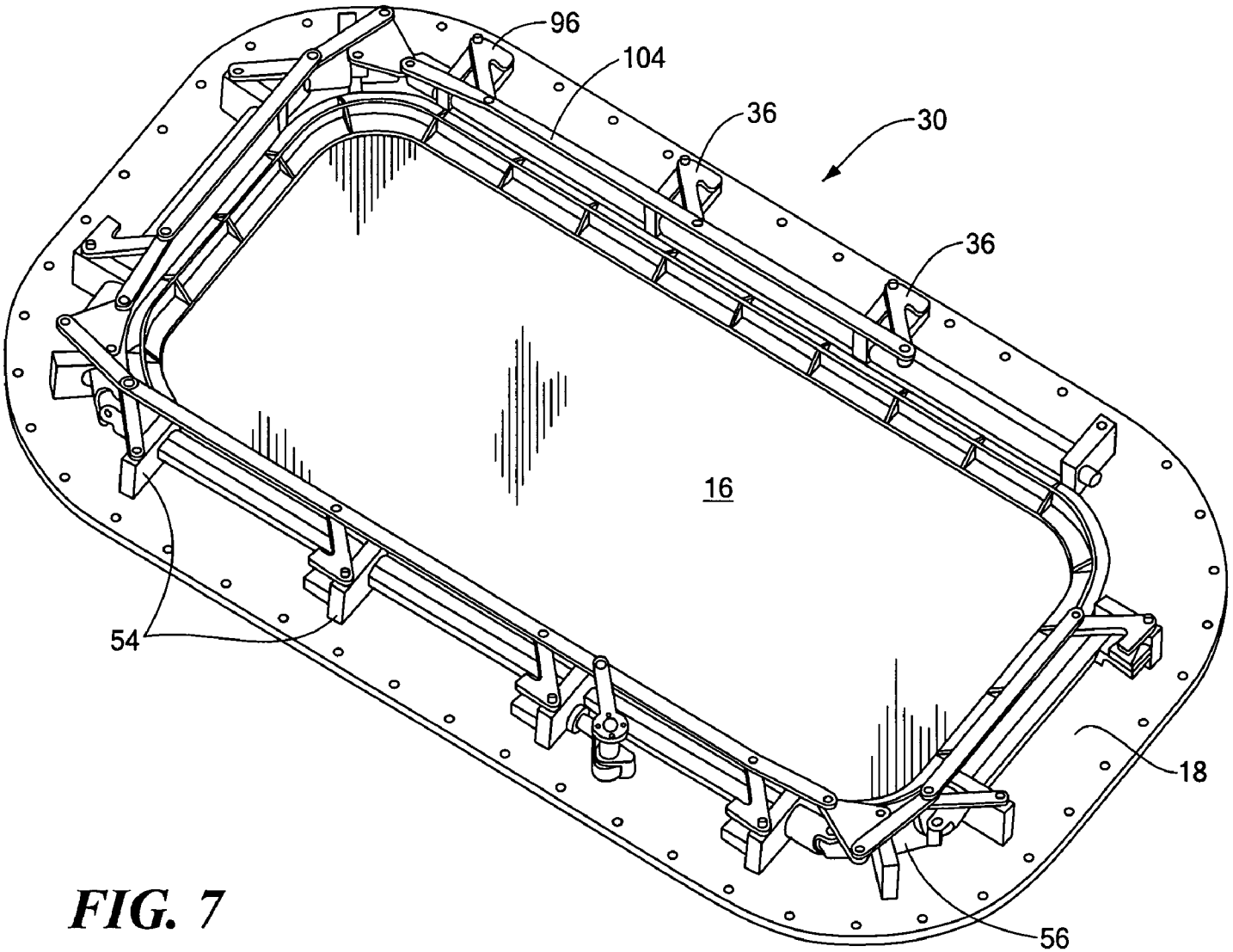
FIG. 7 is an isometric view illustrating the shaft mechanism of FIG. 5 and the linkage mechanism of FIG. 6 in an assembled configuration.
Figure 8:
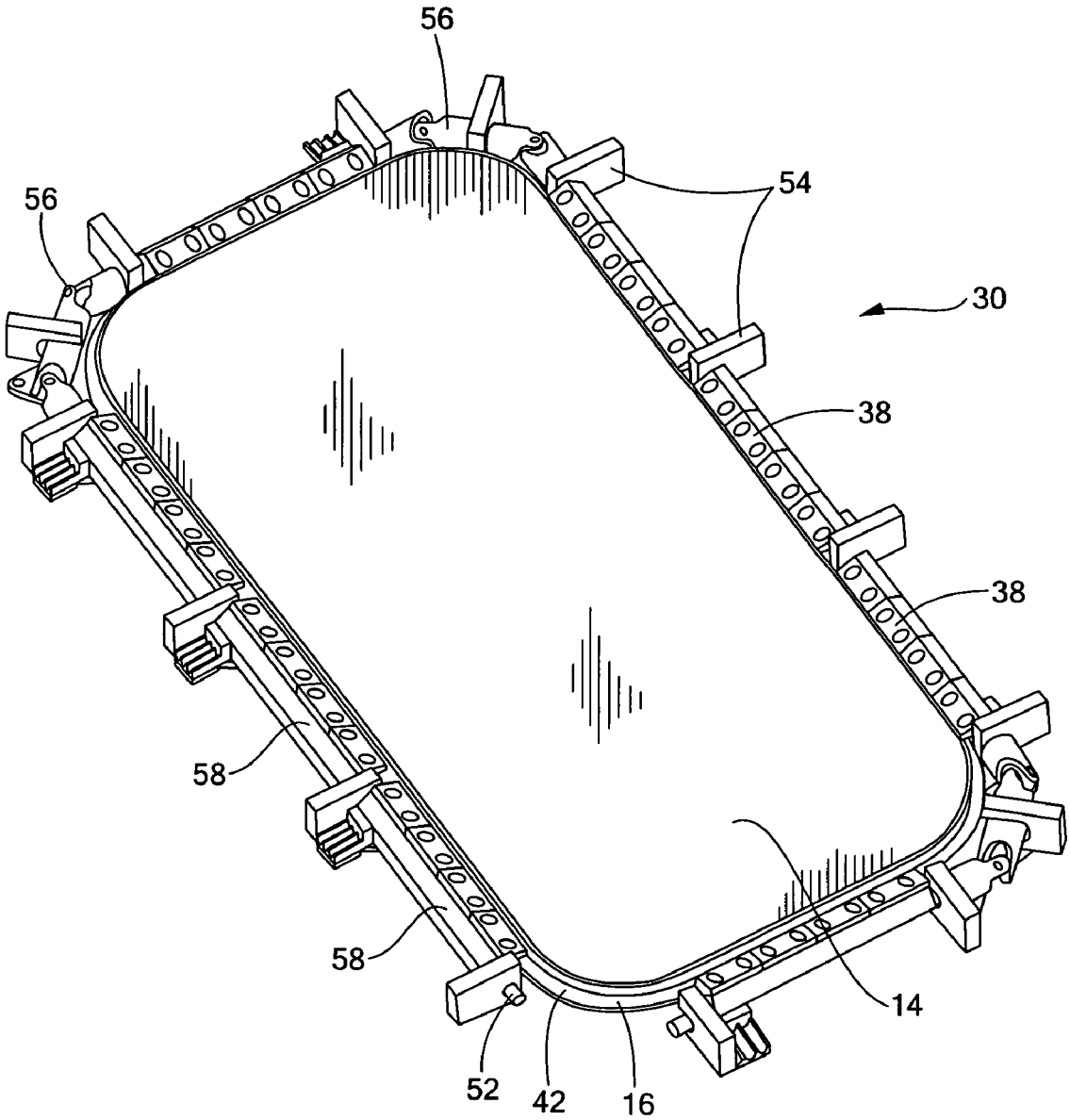
FIG. 8 is an isometric view of the system of FIG. 1 with the surrounding coaming structure removed.
Figure 9:
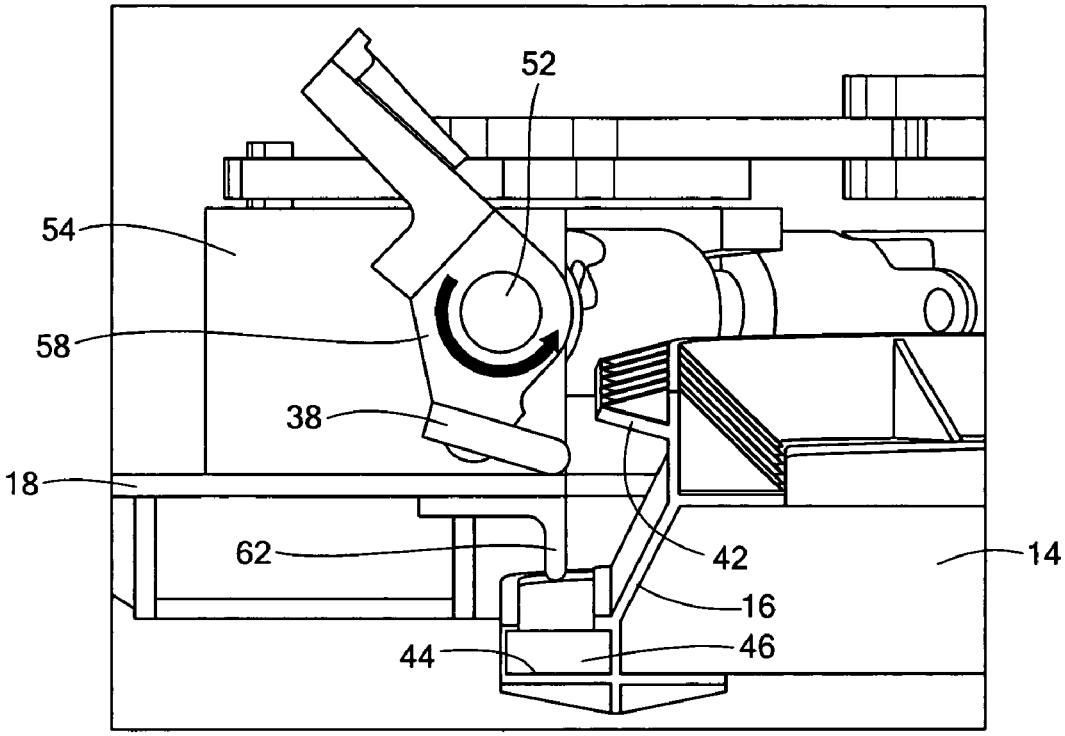
FIG. 9 is a cross-sectional side view of the shaft mechanism of FIG. 5 in an open position.

The operating mechanism 30 is illustrated in FIGS. 5–8. The operating mechanism is mounted to the coaming structure 18 rather than to the panel assembly, to minimize the weight of the panel assembly. The operating mechanism includes a shaft mechanism 32 (FIG. 5) and a linkage mechanism 34 (FIG. 6). In the first stage, the shaft mechanism is actuated to hold the panel assembly closed against the coaming structure. In the second stage, the linkage mechanism engages the shaft mechanism via discrete latching elements 36 to pull the panel assembly into sealing engagement with the coaming structure. Continuous latching elements 38 on the shaft mechanism effect the sealing engagement.

The shaft mechanism includes a plurality of rocker shafts 52 along each edge of the panel assembly. The rocker shafts are supported for rotation on the coaming at suitable shaft supports 54. At the corners of the panels, the rocker shafts are connected by universal joints 56. Thus, rotation of one rocker shaft causes rotation of the other rocker shafts via the universal joints.

A rocker arm 58 is mounted for rotation on each rocker shaft between the shaft supports. The continuous latching elements 38, such as followers or dogging members, are attached to each rocker arm. In the first stage, rotation of the rocker shafts rotates each follower to contact the latching flange 42 on the panel assembly frame to apply a force along at least a portion that extends continuously along the straight edges of the panel assembly.

Figure 10:
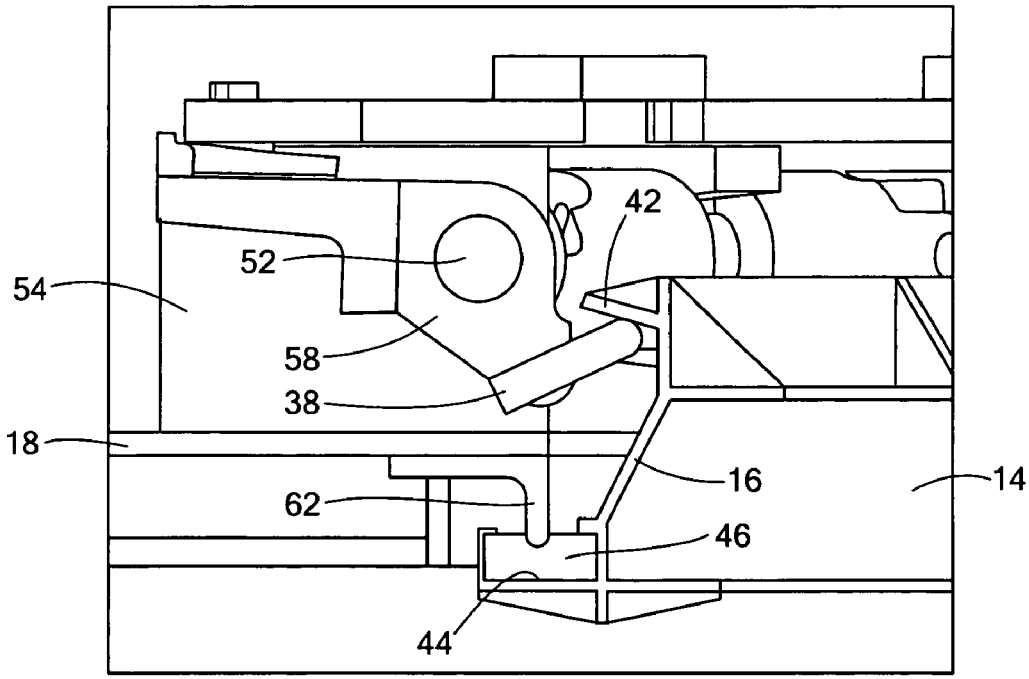
FIG. 10 is a cross-sectional side view of the shaft mechanism of FIG. 5 is a closed position.
Figure 11:
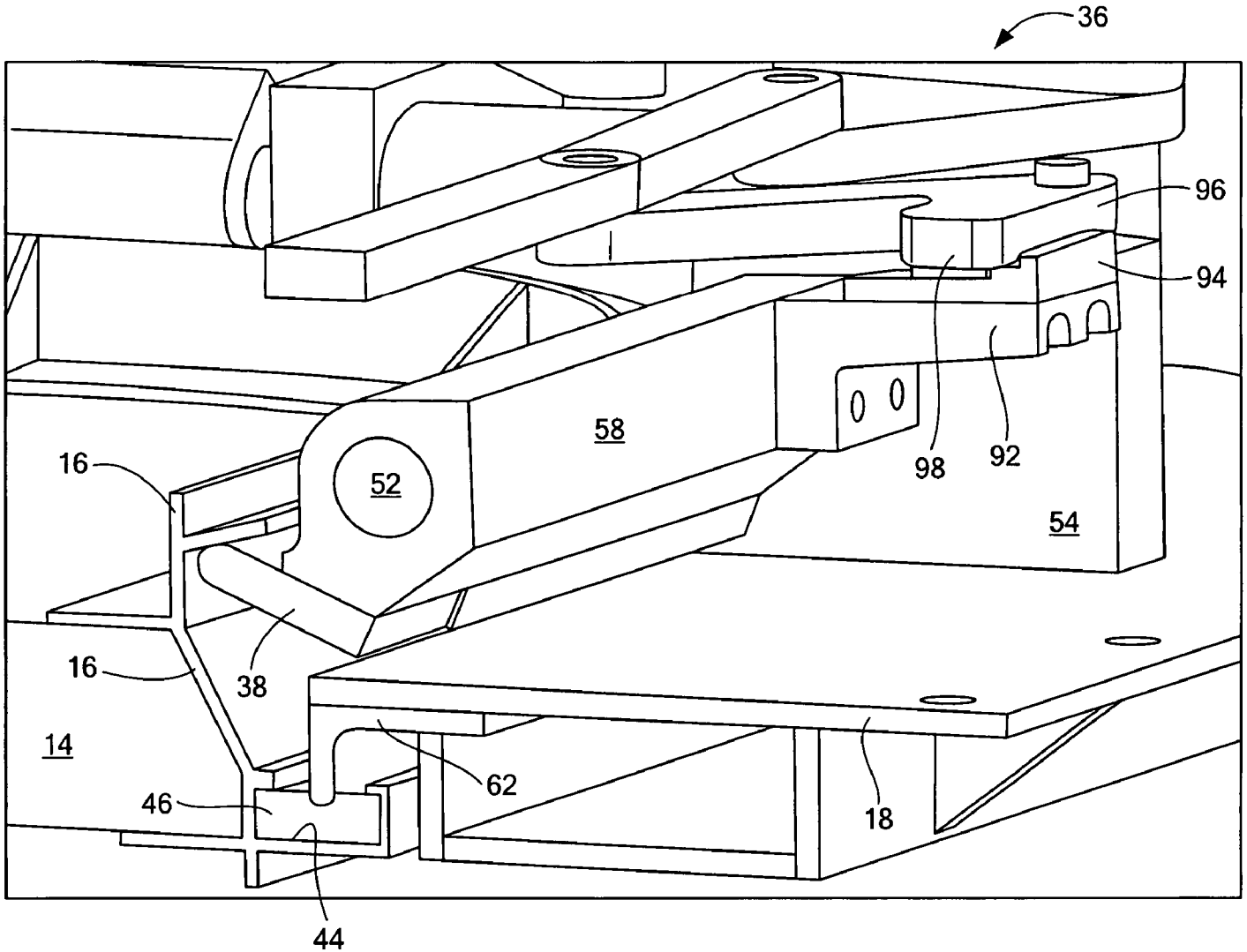
FIG. 11 is a cross-sectional isometric view of the shaft mechanism of FIG. 5 is a closed position.

A continuous knife edge or lip 62 on the coaming structure extends into the gasket 46 in the recess 44 on the frame 16 of the panel assembly. As the rocker shaft is rotated, the follower pushes against the latching flange, pulling the knife edge into contact with the gasket along the perimeter of the panel assembly. See FIGS. 10 and 11.

Figure 12:
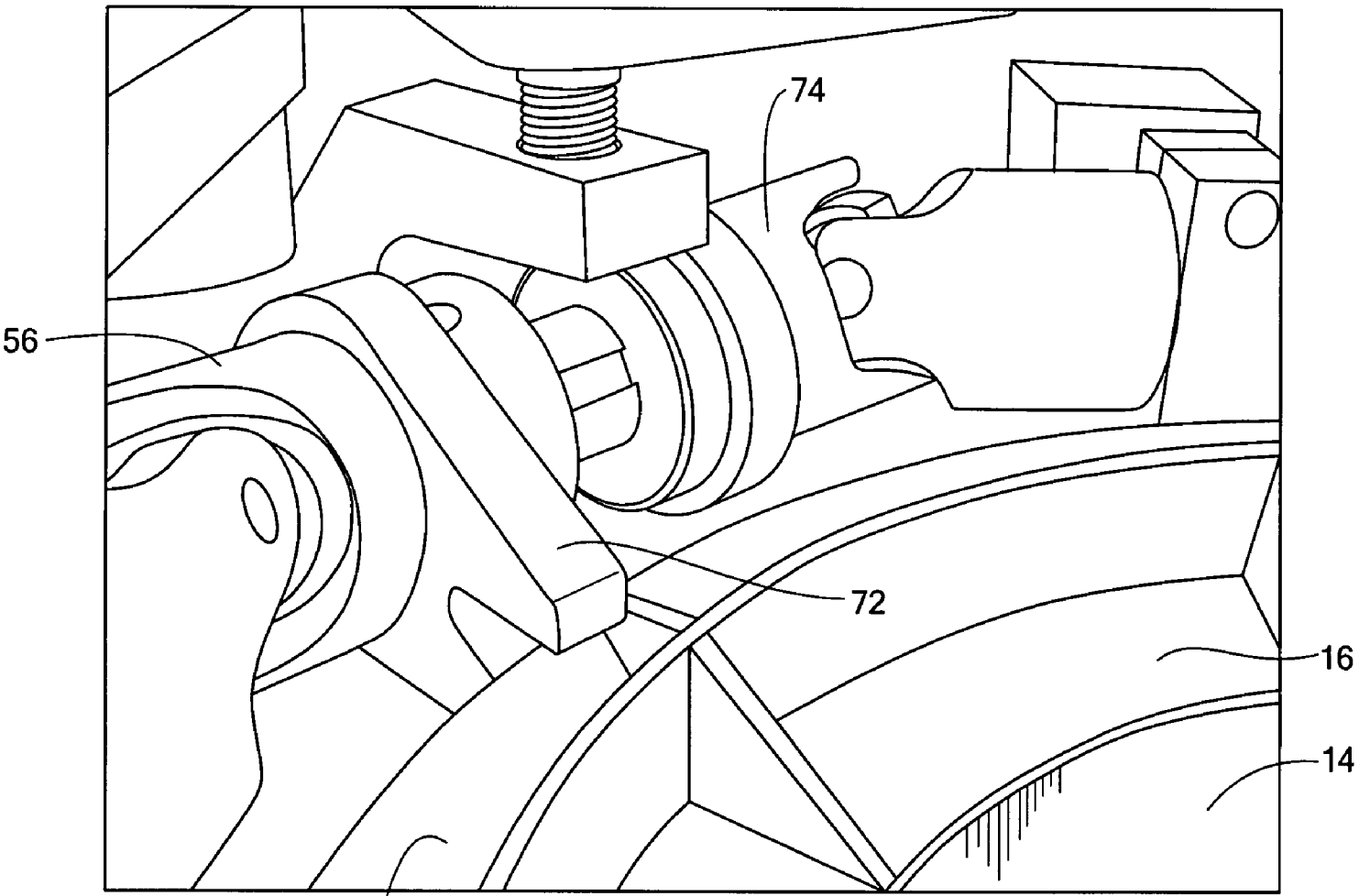
FIG. 12 is a perspective front view of a duckbill latch mechanism of the system of FIG. 1.

In one embodiment, the first stage of rotation is activated by closing the panel assembly to rotate the rocker shaft 52. See FIGS. 12–14. Toward this end, the latching flange 14 on the frame engages a duckbill latch 72 that is pivotally mounted on one or more of the universal joints 56. As the panel is closed, the latching flange 42 contacts and rotates the duckbill latch 72, which in turn rotates the universal joint 56, thereby rotating the rocker shafts.

Figure 13:
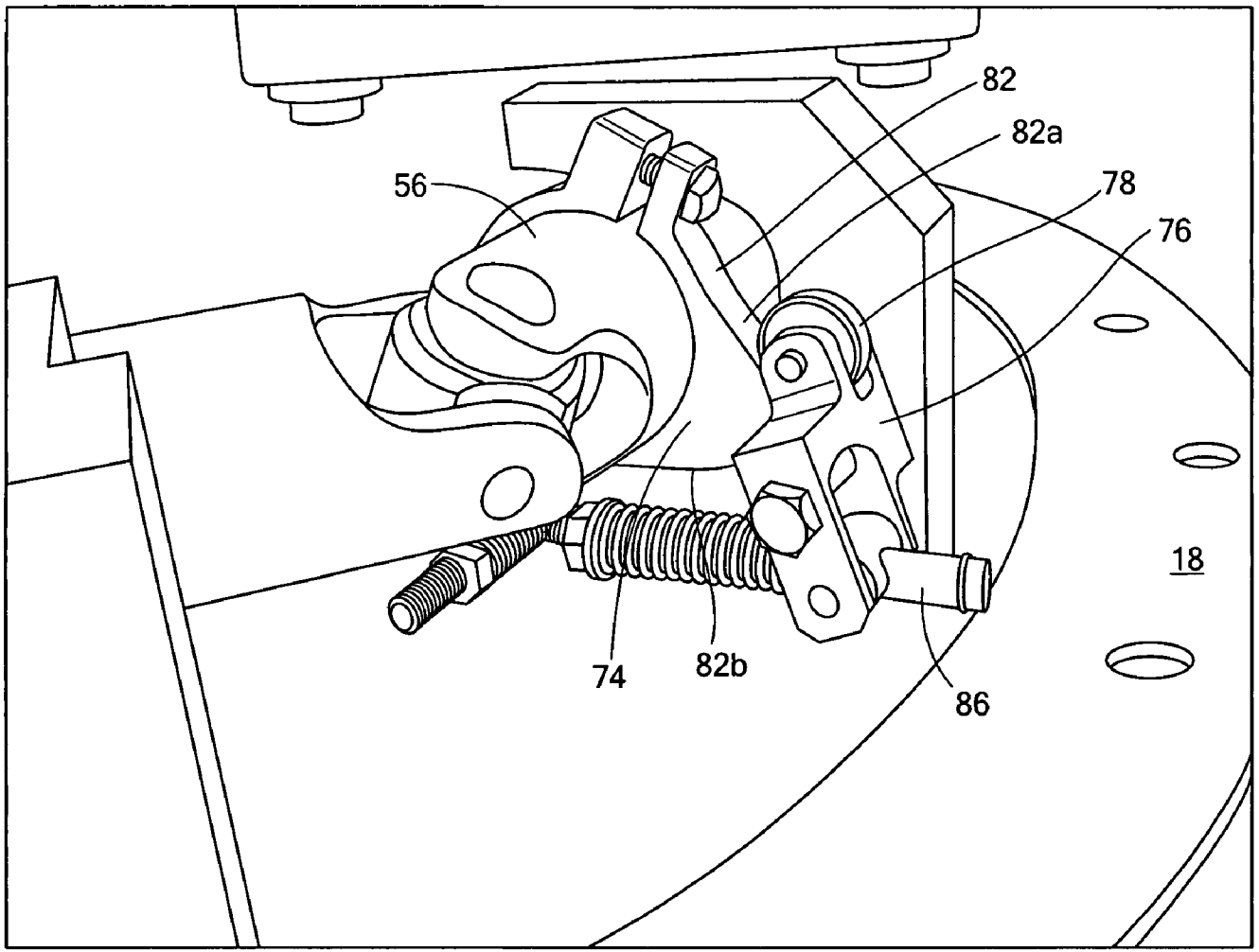
FIG. 13 is a perspective rear view of the duckbill latch mechanism of the system of FIG. 12.
Figure 14:
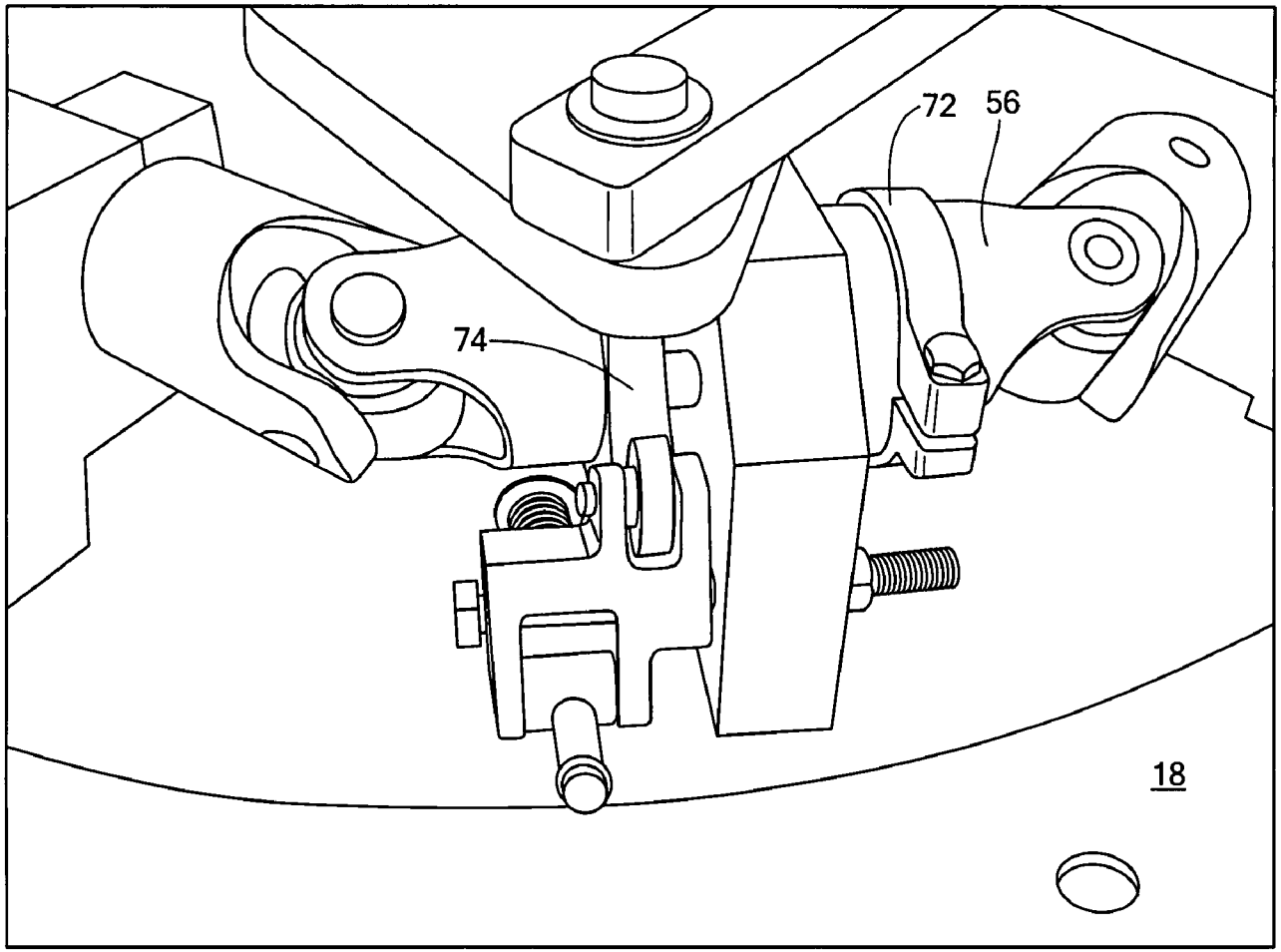
FIG. 14 is a further perspective rear view of the duckbill latch mechanism of the system of FIG. 12.
Figure 15B:
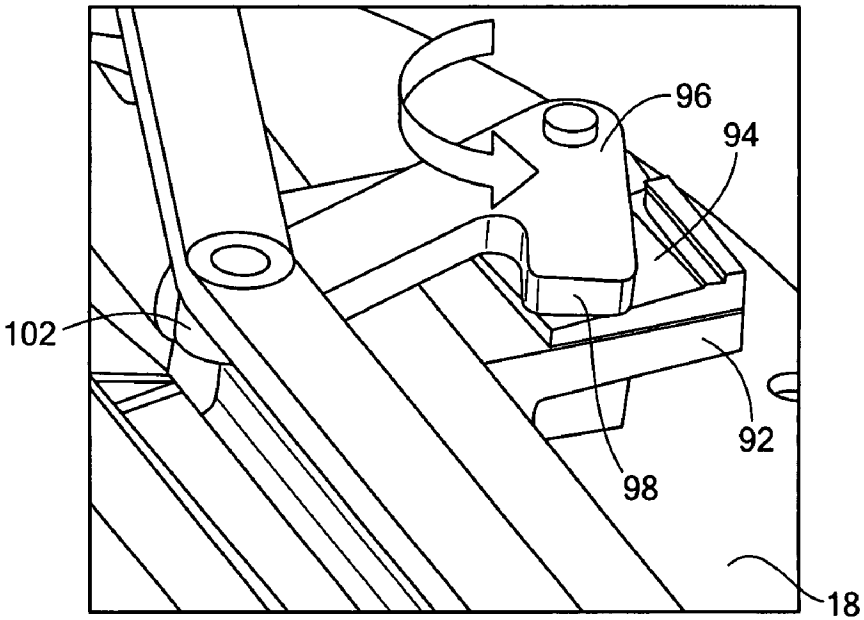
FIGS. 15A, 15B, and 15C are schematic illustrations of the discrete latching mechanism of the linkage mechanism of FIG. 6 in an open position, an intermediate position, and a closed and sealed position.
Figure 15A:
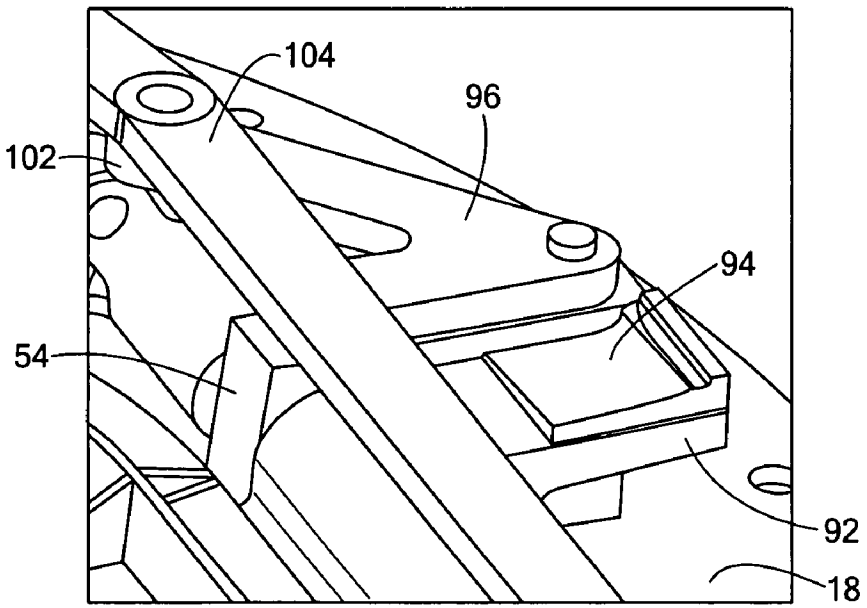
Figure 15C:
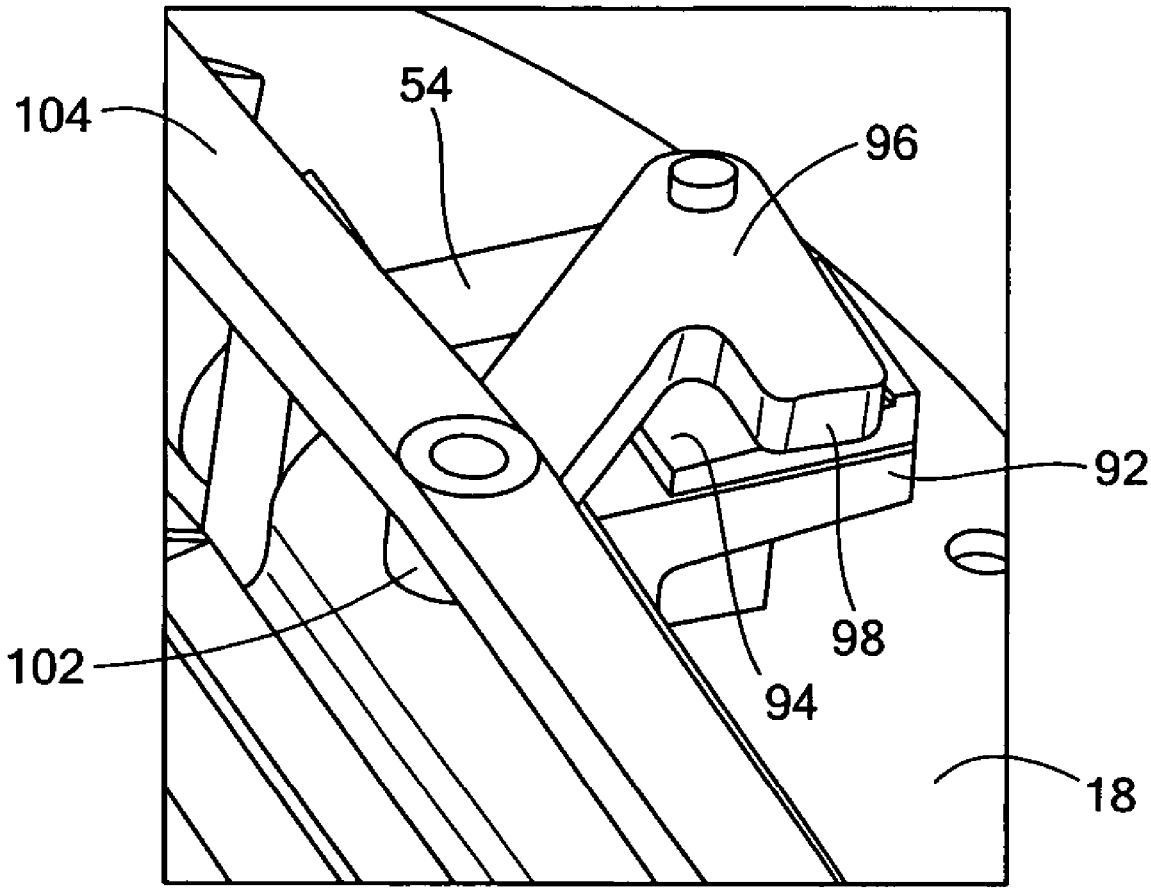
Figure 16:
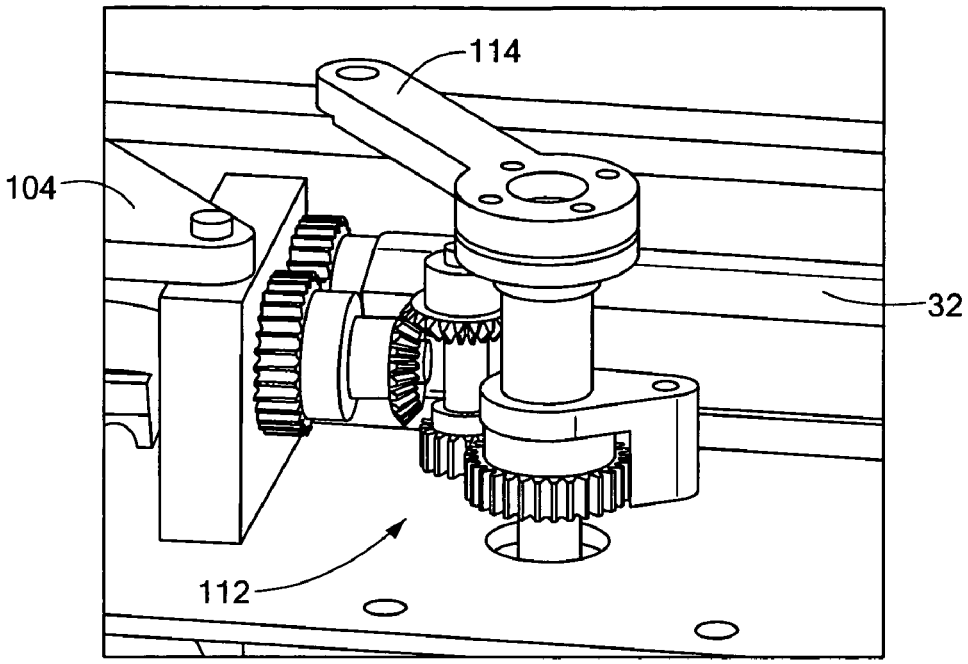
FIG. 16 is an isometric view of a further embodiment incorporating a transmission in the operating mechanism.
Figure 17:
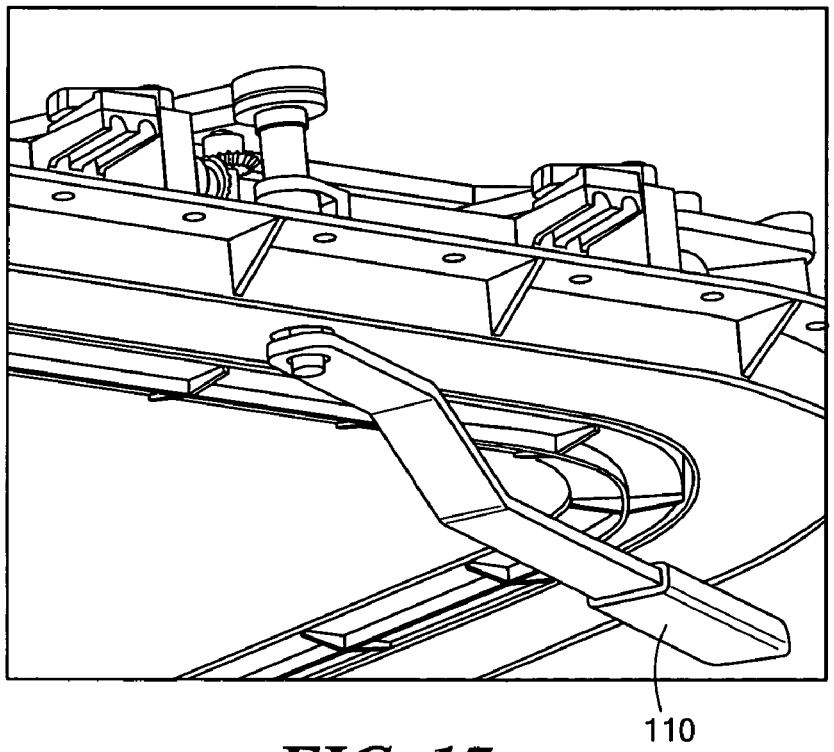
FIG. 17 is a further isometric view of the embodiment of FIG. 16.

A cam element 74 is also mounted on the universal joint 56. A roller rocker 76 including a roller 78 engages the cam surface 82 of the cam element 74. The roller rocker is mounted to the coaming with a strut and spring mechanism 86 to bias the roller into engagement with the cam surface. Movement of the panel assembly to a closed position causes the roller to snap over the cam surface into a closed position. The cam and the roller rocker are synchronized with the rotation of the duckbill latch to ensure that the rocker shafts are in an open or a closed position relative to the panel assembly's open or closed position. In FIG. 13, the roller contacts cam surface portion 82*a* in the closed position and cam surface portion 82*b* in the open position.

In the second stage, the panel assembly is sealed to the coaming structure by pulling the knife edge 62 into sealing engagement with the sealing element or gasket 46. More particularly, the linkage mechanism actuates a plurality of discrete latching elements 36. The discrete latching elements include landing elements 92 pivotably mounted to the rocker arms 58. Each landing element includes a wedge or inclined surface 94. The linkage mechanism includes a plurality of complementary discrete latching members 96 pivotably mounted to the shaft supports 54. One end of the latching member includes a rub pad 98 that rides along an associated wedge. Another end 102 of the latching member is mounted to a planar linkage 104 for movement therewith. The planar linkage includes a plurality of connected links 106 arranged to surround the opening in the coaming structure. A handle 110 actuates the planar linkage. As the planar linkage moves, the discrete latching members rotate, moving the associated rub pads along the wedges, which forces the rocker shaft to rotate further. The further shaft rotation pulls the knife edge into sealing engagement against the gasket. See FIGS. 10 and 11. In this manner, the operating mechanism provides discrete-to-continuous dogging to the composite panel, so that the composite panel can be readily integrated to the metal coaming structure.

Figure 18C:
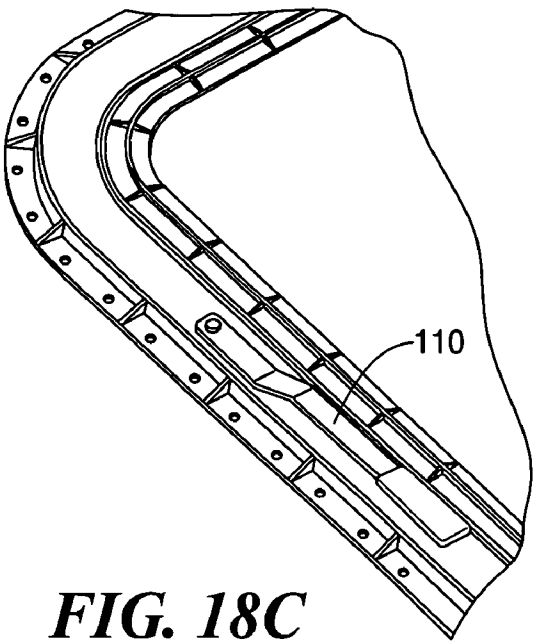
FIGS. 18A, 18B, and 18C illustrate stages of latching the panel assembly employing the transmission of FIG. 16.
Figure 18B:
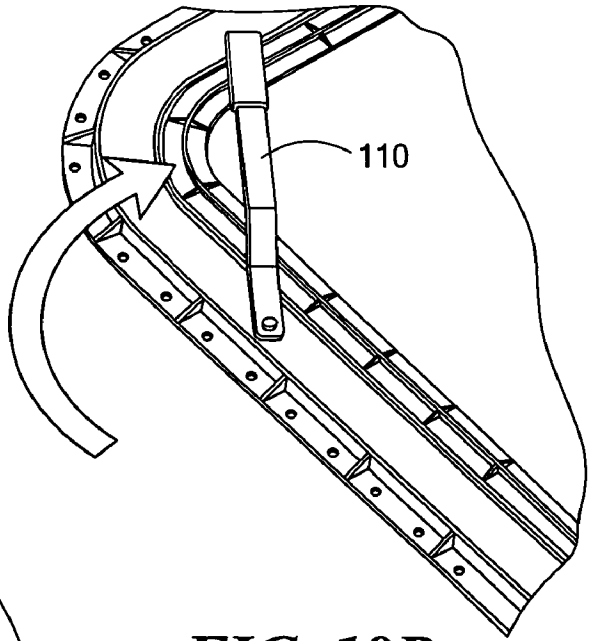
Figure 18A:
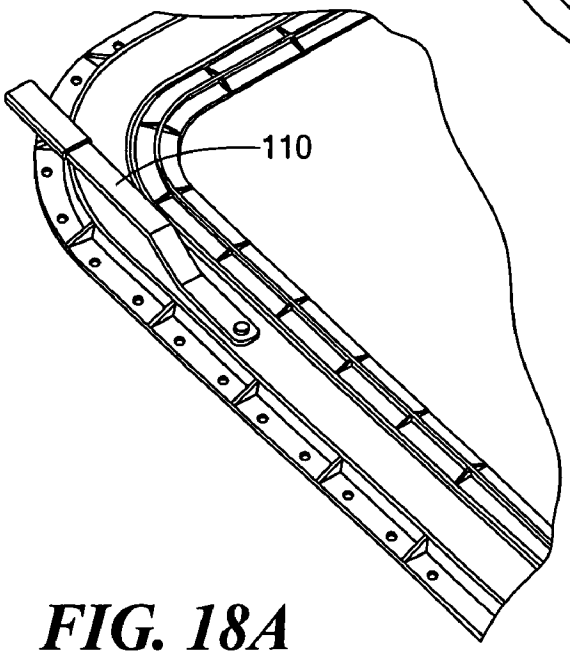

In a further embodiment, a transmission 112 is provided at the handle 110. See FIGS. 16–18C. Movement of the handle actuates the transmission. When the hatch panel is closed, the handle is rotated partially, such as 40° (FIG. 18B), until the followers 38 contact the latching flange. The transmission disengages the shaft mechanism 32 from the handle and engages the planar linkage 104 to actuate a throw rod 114 that drives the planar linkage. Further rotation of the handle a full 180° (FIG. 18C) actuates the linkage to preload the panel frame, sealing the panel. The transmission is preferably enclosed with a suitable cover (not shown) to prevent contamination.

Any desired form of composite panel can be used with the present invention, such as a sandwich panel or a panel with integral stiffeners. The panel can be manufactured in a number of ways, such as with a pultrusion process or a vacuum assisted resin transfer molding process (VARTM) other process alternatives include resin transfer molding, press molding, pultrusion of subcomponents, filament winding of circular frame sections, and prepreg layup. The composite material of the hatch panel contributes to a significant reduction in weight over that of a conventional all-metal hatch and scuttle system. By mounting the latching mechanism to the coaming structure rather than to the hatch panel and frame assembly, the weight of the panel and frame assembly that must by lifted by personnel is minimized.

While described in conjunction with a ship or other marine vessel, the hatch or door system of the present invention can be employed in other situations where the hatch system would be useful, such as in openings to provide access to building roofs or in aircraft. Similarly, although the panel is described as being formed of a composite material, it will be appreciated that the various embodiments of the operating mechanism mounted on the surrounding structure are also operable in conjunction with a metal panel. In this case, the metal frame could be integrally formed with the interior panel, for example, as an edge detail. The invention is not to be limited by what has been particularly shown and described, except as indicated by the appended claims.

What is claimed is:

1. A hatch or door system for closing an opening in a surrounding structure, comprising:

a panel assembly configured to fit within the opening in the surrounding structure in a closed position, the panel assembly comprising an interior panel and a metal frame circumferentially surrounding the interior panel, a latching flange extending outwardly around a substantially continuous perimeter of the frame;

the panel assembly hinged to the surrounding structure for rotation between the closed position and an open position, wherein in the closed position, the opening in the surrounding structure is closed by the panel; and an operating mechanism for retaining the panel assembly in the closed position, the operating mechanism comprising a discrete-to-continuous latching mechanism mounted on the surrounding structure and a shaft mechanism mounted on the surrounding structure, the shaft mechanism comprising a plurality of rotatable shafts extending around the perimeter of the frame, and continuous latching elements mounted on the rotatable shafts to contact the latching flange of the frame, the operating mechanism operative in a first stage wherein the shaft mechanism holds the panel assembly in the closed position and in a second stage wherein the discrete-to-continuous latching mechanism seals the frame within the opening.

2. The system of claim 1, wherein the discrete-to-continuous latching mechanism comprises a plurality of discrete latching elements movable with a planar linkage into contact with the shaft mechanism.

3. The system of claim 2, wherein the discrete latching elements comprise landing elements cooperative with respective wedge surfaces on the rotatable shafts.

4. The system of claim 2, wherein the discrete-to-continuous latching mechanism is operative by a handle attached to the planar linkage.

5. The system of claim 2, wherein the operating mechanism is operative in the first stage to rotate the shaft mechanism into a position holding the panel assembly in the closed position and operative in the second stage to actuate the planar linkage to move the shaft mechanism into sealing engagement with the panel assembly.

6. The system of claim 1, wherein the operating mechanism further comprises a duckbill latch mounted on the shaft mechanism and cooperative with latching flange extending outwardly around the substantially continuous perimeter of the frame to rotate the shaft mechanism upon contact with the latching flange into a position holding the panel assembly in the closed position.

7. The system of claim 6, wherein the operating mechanism is operative in the second stage to actuate a linkage mechanism to move the shaft mechanism into sealing engagement with the panel assembly.

8. The system of claim 1, wherein the operating mechanism provides a sealing force along at least 40% of straight sealed edges of the panel assembly.

9. The system of claim 1, wherein the interior panel is comprised of a fibrous reinforcement impregnated with a matrix material.

10. The system of claim 1, wherein the panel is mounted vertically in the surrounding structure.

11. The system of claim 1, wherein the panel assembly is mounted in the surrounding structure of a marine vessel.

* * * * *